United States Patent [19]

Hillis

[11] Patent Number: 4,502,175

[45] Date of Patent: Mar. 5, 1985

[54] PORTABLE FIRE HOSE CLEANING APPARATUS

[76] Inventor: William J. Hillis, Box 2986 - St. Rte. 13, New Lexington, Ohio 43764

[21] Appl. No.: 470,607

[22] Filed: Feb. 28, 1983

[51] Int. Cl.[3] ..... D06G 1/00; B08B 1/02

[52] U.S. Cl. ..... 15/104.92; 15/40; 15/160

[58] Field of Search ..... 15/40, 104.92, 160, 15/74, 77, 102, 21 B

[56] References Cited

U.S. PATENT DOCUMENTS 589,559 9/1897 Carey ..... 15/40
619,220 2/1899 Porter ..... 15/40
3,471,885 10/1969 McLoughlin et al. ..... 15/40

FOREIGN PATENT DOCUMENTS 365110 11/1938 Italy ..... 15/104.92
366179 1/1963 Switzerland ..... 15/40

*Primary Examiner*—Edward L. Roberts
*Attorney, Agent, or Firm*—Francis T. Kremblas, Jr.

[57] ABSTRACT

A manually portable fire hose cleaning apparatus adapted for conventional connection to a fire hydrant. A frame consisting of an upper and lower platform having an open front portion supports at least two sets of opposing pairs of vertically disposed brushes. An upper and lower set of nozzles are provided in corresponding conduits mounted on the frame to direct a water spray vertically at a position between the sets of brushes. The conduits are connected to a common tubular supply manifold which includes an inlet pipe adapted to be connected to a fire hydrant to supply water. A fire hose is then inserted between opposing pairs of brushes in each set and may be manually manipulated through the water spray and brushes to be cleaned.

2 Claims, 3 Drawing Figures

PORTABLE FIRE HOSE CLEANING APPARATUS

BACKGROUND

The present invention relates to apparatus for washing fire hose and particularly to a lightweight, portable apparatus which is of simple and inexpensive construction.

Fire hose which is of a type which is flat when not inflated, becomes dirty as it lies upon the ground or in pools of muddy water which typically is associated with its use. Further, chemicals which are often used to fight modern fires must be rinsed off the hose as they tend to deteriorate the hose fabric.

Many prior art attempts have been made to devise hose washing or cleaning apparatus for this purpose, however, over the last several decades these attempts have been directed to more complex and relatively very expensive apparatus. Some of these are useful, however, the size and cost are prohibitive for the many small fire departments in small communities which simply cannot afford such expensive equipment.

For example, relatively complex and expensive apparatus for fire hose cleaning are shown in U.S. Pat. Nos. 2,320,173; 2909,794; 4,280,672 and 4,206,526.

Since the more elaborate and expensive devices cannot be afforded by small community fire departments, totally manual efforts involving manual brushing of the hose is employed. The time, effort and relative inefficiency of total manual cleaning tends to lead to less appropriate upkeep of such fire hose and to deterioration and less useful life span of the hose. Therefor there has existed a long standing need for an efficient, yet low cost, apparatus which will competently aid the washing of fire hose.

Other very old devices going back many years, such as shown in U.S. Pat. Nos. 2,179,831; 2,784,832 and 764,435 and 619,220 illustrate the prior attempts to provide fire hose cleaning apparatus which has not proved satisfactory to fulfill this need.

SUMMARY OF INVENTION

The present invention relates to a fire hose washing apparatus which is characterized by a relatively simple, inexpensive construction which is very lightweight and may be manually carried by one person. The apparatus comprises an open frame which includes at least two pairs of opposed brushes through which a fire hose may be inserted and frictionally manipulated between the brushes. Upper and lower sets of nozzles are disposed between each set of brushes and are connected to a manifold which, in turn is adapted for quick and simple connection to a fire hydrant.

The apparatus is designed to permit two persons to manually manipulate the hose between each pair of opposed brushes to accomplish a scrubbing and cleaning action upon the hose in a relatively easy manner. The hose is thoroughly wetted by the water sprayed through the nozzles to loosen and carry away the dirt or debris.

OBJECTS

It is a primary object of the present invention to provide a fire hose washing or cleaning apparatus which is lightweight and inexpensive, yet highly efficient to properly wash a fire hose.

It is another object of the present invention to provide an apparatus of the type described which is of simple, relatively inexpensive construction and which can be easily transported and used at the site of a fire or conveniently used at or near the station house of the fire department.

It is a further object of the present invention to provide an apparatus of the type described which may be used to clean a fire hose in a manner comparatively equal to the more complex and expensive piror art devices.

It is still another object of the present invention to provide an apparatus of the type described which permits a relatively wide range of hose sizes to be washed using the samed apparatus.

Further object and advantages of the present invention will be apparent from the following description, reference being had to the accompanying drawings wherein a preferred form of embodiment of the invention is clearly shown.

IN THE DRAWINGS

DETAILED DESCRIPTION

Figure 1:
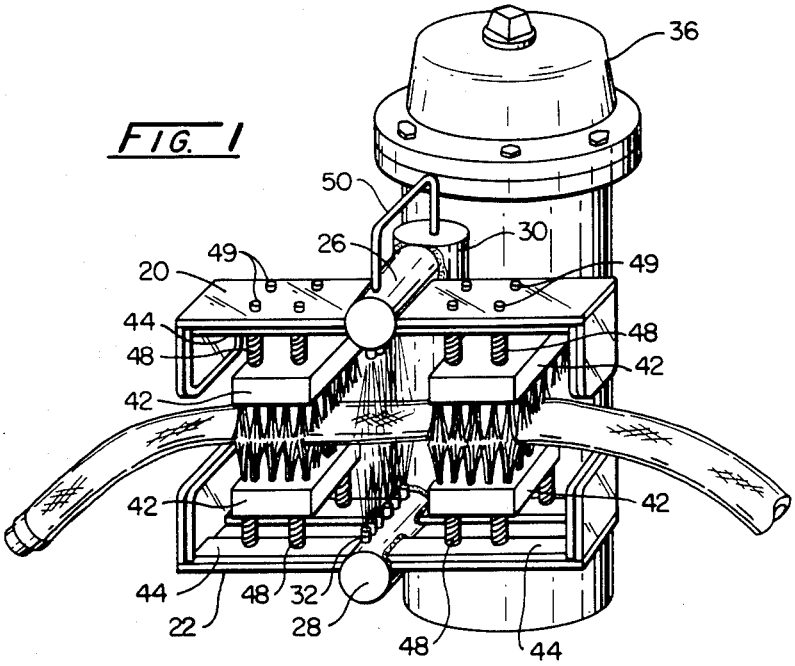
FIG. 1 is a perspective view of the fire hose washing apparatus constructed in accordance with the present invention illustrated in a working position connected to a conventional fire hydrant.
Figure 2:
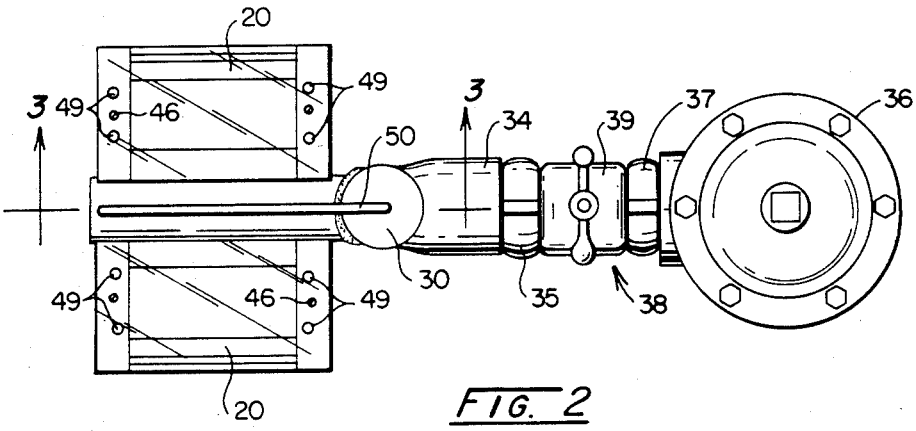
FIG. 2 is a top plan view of the apparatus shown in FIG. 1.
Figure 3:
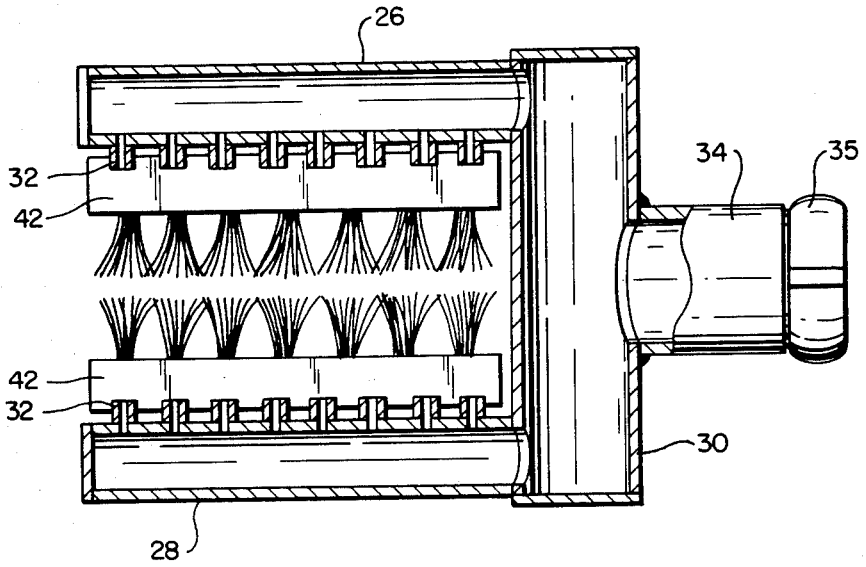
FIG. 3 is a side section view of the apparatus shown in the preceding figures, the section being taken along line 3—3 in FIG. 2.

A manually portable fire hose washing apparatus constructed in accordance with the present invention is shown in FIGS. 1 and 2 and includes an open frame means comprising an upper platform 20 and a lower platform 22. Each is supported in vertically spaced relationship by a respective one of a pair of tubular members 26 and 28. Tubular members 26 and 28 are fixed to a vertical manifold member 30.

Each tubular member 26 and 28 is provided with a plurality of nozzles such as 32 which are directed inwardly of the frame toward the opposite member 26 or 28. Members 26 and 28 are communicated to manifold member 30 which, in turn, is provided with an inlet pipe 34 and coupling member 35. Coupling 35 is adapted to be connected to a conventional fire hydrant 36 via a standard valve assembly indicated generally at 38. Such a valve assembly is conventional and consists of conventional coupling member 37 and an on-off valve 39.

In this manner water available from a conventional fire hydrant may be communicated to manifold 30, tubular members 26 and 28 and outlet through nozzles 32 to form a vertical spray directed from the lower and upper members 26 and 28 toward each other.

Two horizontally spaced sets of brush means are mounted on the frame. Each set comprises an opposing pair of brushes 42. The upper brush of each set is fixed to upper platform 20 and the lower brush of each set if fixed to lower platform 22.

Preferably, each set of brush means are removably mounted to the respective platforms 20 and 22, such as by a mounting plate 44 removably fixed to each platform via threaded fasteners such as 46. This permits the brush sets to be replaced upon becoming worn, however, such replacement is essentially the only maintenance required.

Each brush 42, which is similar to a conventional heavy duty scrub brush, may be removably mounted to plate 44 by providing suitable holes for frictionally or threadably receiving posts 49 which in turn are fixed to mounting plate 46. However, other conventional means for mounting the brushes 42 in the position shown could be employed without departing from the spirit of the present invention.

As shown in FIGS. 1 and 2, preferably, brushes 42 are resiliently mounted for vertical displacement against the bias force of springs 48 disposed in surrounding relationship to each post 49 and seated against plate 44 and the base supporting the bristle portions of each brush 42.

To resiliently mountbrushes 42, each post 49 slideably extends through suitable aligned holes in plates 44 and platform 20 to expose an upper threaded position which receives a threaded stop nut or cap member, not shown, to retain each post in position against further downward displacement. Therefore posts 49 are free to slide upwardly as spring 48 are compressed by a sufficient upward force upon brushes 42 and return to the original disposition as biased by springs 48 and limited by the stop caps on the upper end of each post 40. Either the upper or lower set of brushes or both may be resiliently mounted which permits easier insertion of hoses of different thickness to be cleaned while maintaining an adequate engagement with the hose for scrubbing purposes.

Preferably a handle means, such as 50, may be provided to facilitate carrying the device.

In use, the hose washing apparatus is manually transported to a fire hydrant, such as 36. After removing the conventional face plate on such hydrants, conventional coupling member 37 and on-off valve 28 are attached to the fire hydrant and to the coupling 35 on inlet pipe 34.

The end portion of the fire hose to be cleaned is manually inserted between each set of brushes through the open front portion to be positioned as shown in FIG. 1.

Then two persons are required to manually pull a section of the hose back and forth from each side of the apparatus. The valve 39 is turned to the on position to supply water to manifold 30, members 26 and 28 and nozzles 32 which direct the water onto the upper and lower surfaces of the hose.

After a particular section of the hose has been manipulated sufficiently between the sets of brushes to obtain the necessary scrubbing of that section, the hose is pulled toward the forward end, which is to the left as seen in FIG. 1, and the action is repeated on the next section of hose.

When a coupling member on the length of hose is encountered, that hose section is taken out and reinserted as previously described with the coupling member placed beyond the brush set on the left as seen in FIG. 1 and cleaning of the remaining length of hose continues.

While the manipulation of the hose is manual, it is much easier than manipulating the brushes and does not require undue strength or effort. Further, the nozzles 32 are designed to direct a relatively forceful spray or jet of water upon the hose which effectively wash way much of the debris or harmful chemicals to which the hose may have been exposed.

Between the action of the water spray and the brushes, very effective cleaning of the hose may be accomplished in a surprisingly efficient and quick manner.

Once the hose has been cleaned, it can be transported to the drying racks in any conventional manner as previously employed at the given fire station. The cleaning apparatus is disconnected from the fire hydrant by appropriately uncoupling member 37.

The lightweight and very compact construction permits the apparatus to be easily carried by one person back to the fire truck or into the fire station for storage until needed.

In view of the foregoing description, it should be readily appreciated that the present invention provides a very significant and satisfactory solution to fulfill the need of an inexpensive, yet very efficient device to wash and clean fire hose. The easy portability, low cost, and competent cleaning action provides the small fire department with a low budget a very attractive alternative between the very expensive and elaborate piror art devices and the completely manual scrubbing and washing operation heretofore employed.

What is claimed is:

1. A portable fire hose cleaning apparatus comprising in combination, a frame means supporting at least two sets of horizontally spaced fixed brush means, each of said sets including a pair of opposed brush means having the ends of their respective bristle portions disposed in vertical alignment and closely adjacent to the ends of the bristle portions in other of said pair, a vertically disposed supply conduit member provided with a horizontally disposed inlet pipe means for connection to a conventional fire hydrant and with a pair of outlets, each communicating with one of a pair of vertically spaced, horizontally extending tubular members, each of said tubular members being connected to said frame means between said sets of brush means, and provided with nozzle means having outlets directed in opposing directions to provide a water spray directed vertically between said sets of brushes.

2. A portable fire hose cleaning apparatus adapted for manual transport and connection to a fire hydrant comprising in combination, a tubular manifold member including a vertically disposed inlet conduit section having a horizontally disposed inlet pipe means adapted for conventional connection to fire hydrant and a pair of outlets, each communicating with a one of a pair of horizontally extending, vertically spaced outlet pipe means, each of said pipe means provided with a plurality of nozzle means disposed to direct a water spray toward the other of said pipe means, an upper platform connected to and extending horizontally from each side of one of said pipe means, a lower platform connected to and extending horizontally from each side of the other of said pipe means, a plurality of sets of opposing pairs of brush means, each of said pairs having the upper brush means connected to said upper platform and the lower brush means connected to said lower platform, at least one set of said brush means being disposed on the opposite side of pipe means from the other sets, whereby a fire hose can be inserted between each pair of brush means for reciprocal movement past said brush means and the portion of said hose between said sets is disposed in the water sprayed from said nozzle means.

* * * * *